United States Patent [19]

Longo et al.

[11] 4,092,265

[45] May 30, 1978

[54] PROCESS FOR PREVENTING ECOLOGICAL CONTAMINATION DUE TO RADIOACTIVE RUTHENIUM, MOLYBDENUM OR TECHNETIUM

[75] Inventors: John M. Longo, New Providence; Edward T. Maas, Jr., Kendall Park, both of N.J.

[73] Assignee: Exxon Research & Engineering Co., Linden, N.J.

[21] Appl. No.: 727,468

[22] Filed: Sep. 28, 1976

[51] Int. Cl.[2] ..... G21F 9/02

[52] U.S. Cl. ..... 252/301.1 W; 55/72; 55/74; 423/2; 423/22; 423/249; 423/593

[58] Field of Search ..... 252/301.1 W; 423/2, 423/249, 210, 22, 593; 55/72, 74

[56] References Cited

U.S. PATENT DOCUMENTS

| | | | |
|---|---|---|---|
| 2,964,130 | 12/1960 | Newby et al. | 55/72 |
| 3,018,161 | 1/1962 | Erlebach et al. | 55/74 |
| 3,153,566 | 10/1964 | Spector | 423/249 |
| 3,294,701 | 12/1966 | Vogel et al. | 423/593 |
| 3,755,553 | 8/1973 | Kutolin et al. | 423/593 |
| 3,819,536 | 6/1974 | Betta et al. | 252/462 |
| 3,835,069 | 9/1974 | Gandhi et al. | 252/462 |
| 3,972,837 | 8/1976 | Acres et al. | 423/593 |

*Primary Examiner*—Richard E. Schafer
*Assistant Examiner*—Deborah L. Kyle
*Attorney, Agent, or Firm*—Joseph J. Allocca

[57] ABSTRACT

Radioactive ruthenium, molybdenum and technetium which are by-products of the fission of $U^{235}$ are prevented from contaminating the environment during nuclear fuel reprocessing procedures by passing the radioactive ruthenium, molybdenum and/or technetium oxides over a trapping agent selected from the group consisting of alkaline earth compounds, lanthanide compounds and lead compounds at a temperature of over 500° C. leading to the formation of nonvolatile ruthenates, molybdates and technetates. By this process volatile radioactive $RuO_4$, $MoO_3$ and $Tc_2O_7$ are kept from escaping into the atmosphere during nuclear fuel reprocessing. The stable ruthenates, molybdates and technetates thus formed can then be easily isolated and contained during the period of maximum radioactive decay.

11 Claims, 6 Drawing Figures

Figure I
Ru CONCENTATION PROFILE IN CaO BED
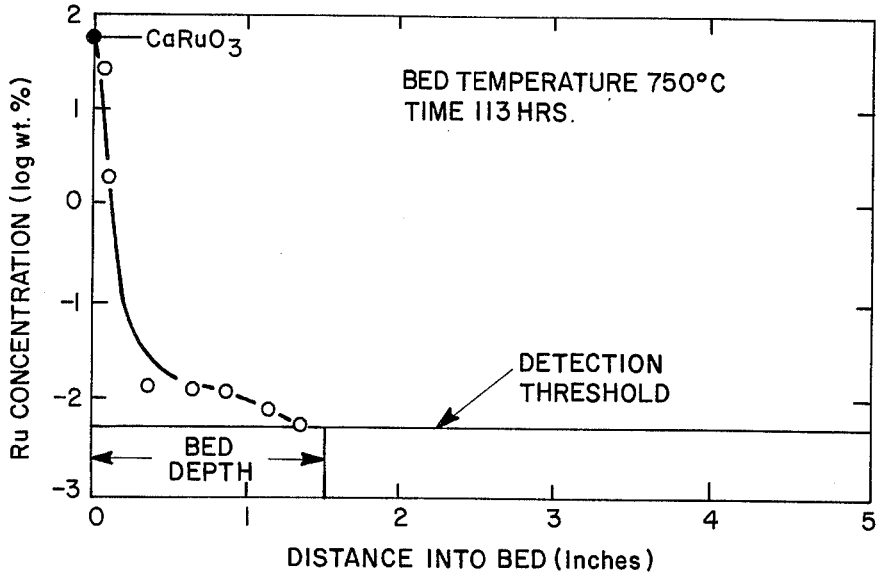
Figure II
Ru CONCENTRATION PROFILE IN $SrCO_3$ BED
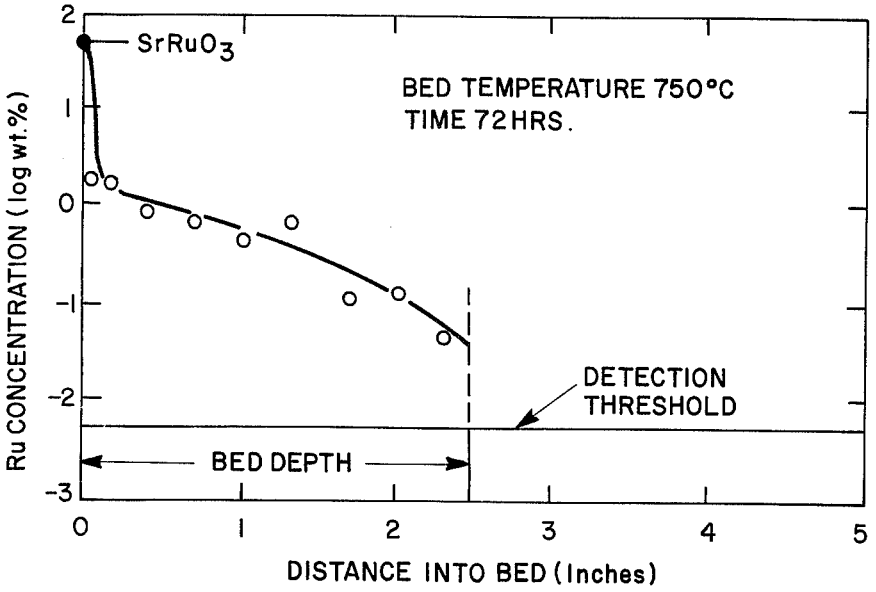

Figure III
Ru CONCENTRATION PROFILE IN $BaCO_3$ BED
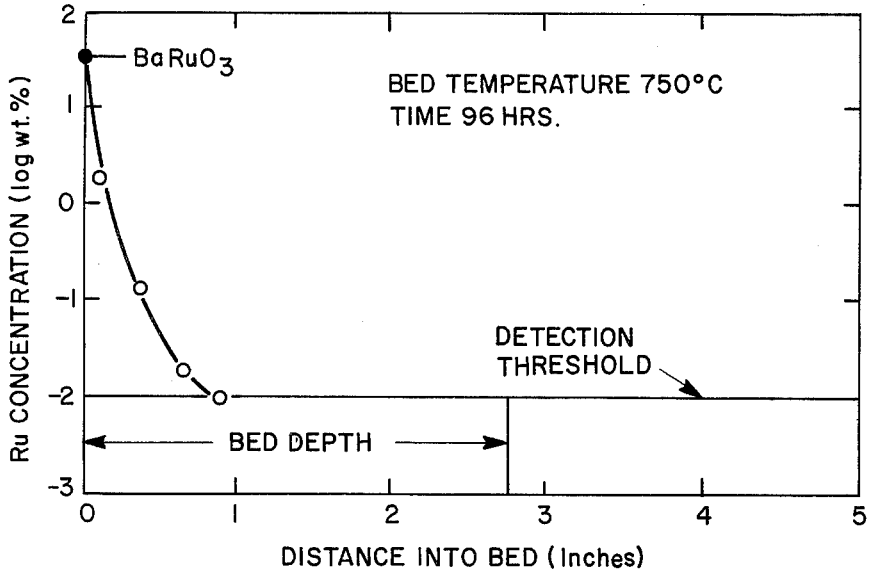
Figure IV
Ru CONCENTRATION PROFILE IN $CaCO_3$ BED
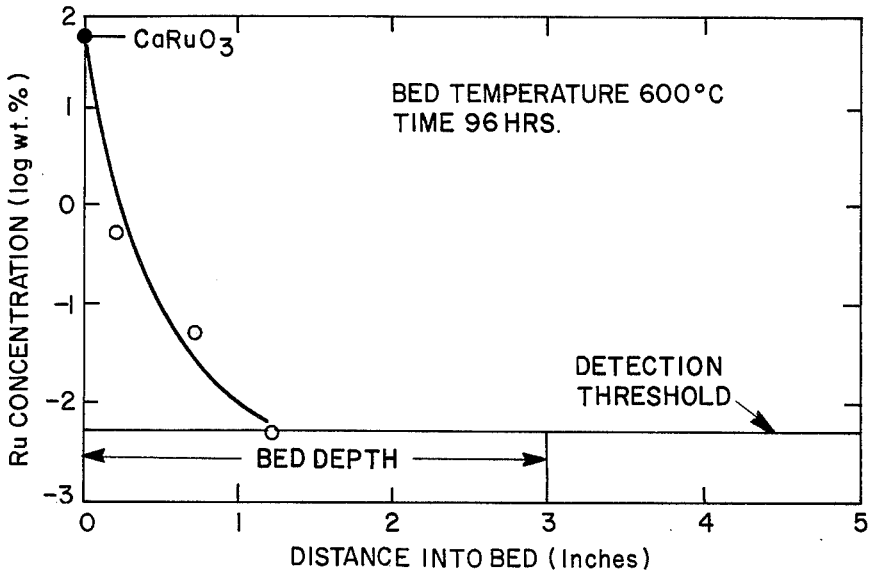

FIGURE V
Ru CONCENTRATION PROFILE IN $BaCO_3$ BED
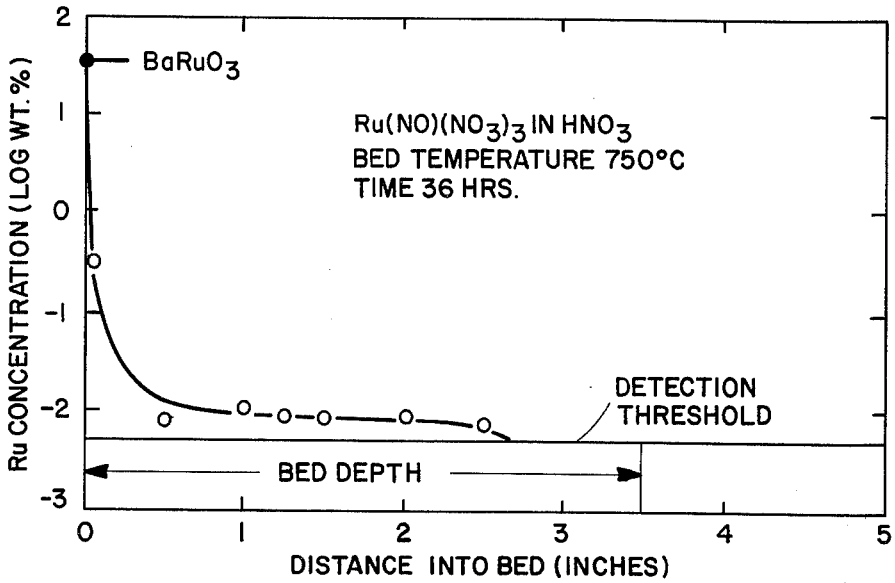
FIGURE VI
Ru CONCENTRATION PROFILE IN $BaCO_3$ BED
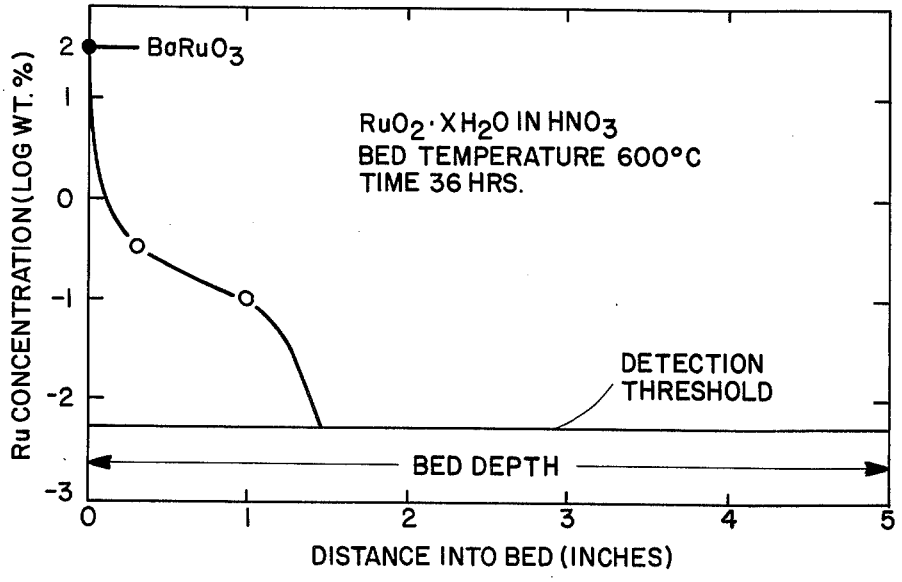

PROCESS FOR PREVENTING ECOLOGICAL CONTAMINATION DUE TO RADIOACTIVE RUTHENIUM, MOLYBDENUM OR TECHNETIUM

BACKGROUND OF THE INVENTION

A process is described for the removal of volatile radioactive oxides of ruthenium, molybdenum and technetium from the process gases and effluent gases produced during nuclear fuel reprocessing procedures which comprises passing the gaseous stream containing the volatile radioactive ruthenium, molybdenum and/or technetium oxides over a trapping agent selected from the group consisting of alkaline earth compounds, lanthanide compounds and lead oxides at a temperature of from 400° to 1000° C, preferably 500°-700° C which results in the formation of nonvolatile ruthenates, molybdates and/or technetates. The nonvolatile compounds thus formed can be easily handled and kept isolated from the environment during the period of maximum radioactive decay. Alternatively, the trapping agent may be supported.

During the nuclear fission of $U^{235}$, ruthenium, molybdenum and technetium are produced as fission products. The ruthenium produced by the nuclear fission process consists of two isotopes, $Ru^{103}$ and $Ru^{106}$ both of which are radioactive. Together these isotopes produce $6.73 \times 10^5$ Curies of radiation and $3.75 \times 10^2$ watts of energy per metric ton of fuel. $Ru^{106}$ has the longer half-life ($t\frac{1}{2}$ = 1 year) and is involved in a decay series which results in a very energetic beta decay. Considering subsequent released decay energy, the ruthenium present in spent fuel is responsible for approximately two watts/gram of ruthenium. The $t\frac{1}{2}$ of $Ru^{106}$ dictates that any ruthenium recovered during nuclear fuel reprocessing procedures be isolated and retained for approximately 20-30 years. During this time period, the radioactive ruthenium must be prevented from attaining any volatility through high oxidation state oxide formation.

One contemplated method of nuclear fuel reprocessing involves the dissolution of the spent fuel prior to subsequent separation steps. To insure complete dissolution, the materials are subjected to extremely oxidizing conditions. This oxidation, however, would not be elementally specific and hence any oxidizable species in the solution would be oxidized. The radioactive ruthenium and also molybdenum and technetium produced as uranium fission by-products would be subjected to this oxidation step resulting in the generation of $RuO_4$, $MoO_3$ and $Tc_2O_7$. It is well-known, for example, that $RuO_4$ has an appreciable vapor pressure over aqueous solutions. The typical quantitative analytical technique used to determine the ruthenium content of a solution involves the distillation of $RuO_4$ out of an aqueous solution. This same degree of high volatility will be exhibited by the radioactive ruthenium and will consequently pose a serious isolation problem in the reprocessing system.

PRIOR ART

A number of metal oxides have been proposed in the past as traps for volatilized ruthenium oxides. Among these are alumina, sodium and calcium aluminosilicates, iron oxide, and oxides of Cr, Ni, Co and Ti. The materials trap ruthenium from gaseous $RuO_4$ in varying degrees of efficiencies in both reversible and nonreversible manners. See Woodland E. Eilebach and Danay T. Nishimura Can. 583,134 corresponding to U.S. Pat. No. 3,018,161. Cs and/or Ru are removed from gaseous stream by the irreversible formation of thermally stable compounds using metal oxides of iron, nickel, chromium, cobalt or titanium as traps at a process temperature of from 400°-1000° C. at a velocity of from 0.2 → 5 ft/sec.

The best results are obtained with iron oxide for which experiments have shown removal efficiencies on the oxides of 99.9% attainable. It is believed that the mechanism for this reaction in the case of iron oxide utilizes the material only as a support for the reaction:

$$RuO_4\,(gas) \rightarrow RuO_2\,(solid) + O_2\,(gas)$$

It is surmised that the iron oxide is present in a high surface area form and that the variability of the oxidation state of iron allows the iron oxide to act as an oxygen sink to provide the reducing conditions necessary for devolatilization. It is reported that the final product $RuO_2$ is "fixed" by the iron oxide to prevent subsequent revolatilization. It must be noted, however, that there is no known mixed metal oxide which forms between ruthenium and iron. Furthermore, no solid solution formation between oxides of these metals is known which could aid in further stabilizing the devolatilized Ru oxide.

U.S. Pat. No. 3,819,536 to Dalla Betta et al discloses a process for producing a ruthenium catalyst which comprises preparing an alkaline earth oxide on catalytic support material substrate which is subsequently impregnated with a hydrated halogenated ruthenium compound which is reduced to ruthenium metal and then heated to a temperature of from 800° C to 1000° C for from 10 minutes to 6 hours to yield a ruthenate. It should be noted that the ruthenate is formed in a multistep process and not from the mere contracting of a volatile Ru oxide with an alkaline earth substrate.

U.S. Pat. No. 3,835,069 to Gandhi et al teaches a ruthenium catalyst system and method for producing same. The ruthenium catalyst is ground into a fine powder, dispersed in alumina and applied to a support. The ruthenium catalyst which is ground into a fine powder has been presynthesized by reacting ruthenium with a compound selected from the group consisting of alkaline earth materials, rare earth materials or mixtures of rare earth materials. The ruthenium in metal form is reacted with the selected support at a temperature of about 1000° C in air. There is no teaching that a volatile ruthenium oxide will spontaneously form a nonvolatile alkaline earth-ruthenate at temperatures in the range of 500° C. As can be seen, the prior art recognized that ruthenium can be prevented from volatilizing as $RuO_4$ by being bonded to a support such as alkaline earth material. There is no teaching, however, that once volatile $RuO_4$ is formed, it can be induced to bond to a support so as to form a nonvolatile ruthenate. The process of the instant invention utilizes the newly discovered phenomenon.

It has been discovered and forms the basis of this disclosure that volatile ruthenium oxides, molybdenum oxides and technetium oxides spontaneously react with materials selected from the group consisting of the oxides of calcium, strontium, barium, the lanthanides, lead and mixtures thereof and the carbonates of calcium, strontium, barium, the lanthanides and mixtures thereof and mixtures of the oxides and carbonates of calcium, strontium, barium, lead and the lanthanides to yield nonvolatile mixed metal ruthenates at temperatures above 400° C and below 1000° C. This discovery is of tremendous importance in the area of nuclear fuel reprocessing since radioactive ruthenium, molybdenum and technetium are natural uranium fission products. Since the nuclear fuel reprocessing techniques currently envisioned utilize a strong oxidizing atmosphere as one of the process steps and since this step is not selective, radioactive ruthenium, molybdenum and technetium oxides will of necessity be generated. Certain of these oxides will be volatile and thereby be capable of escaping from the processing zone into the open environment. This problem is compounded when the volatile material constitutes a radioactivity hazard. The discovery of the spontaneous formation of stable nonvolatile ruthenates, molybdates and/or technetates from alkaline earth oxides and/or carbonates, lanthanum oxides and lead oxides and gaseous ruthenium, molybdenum or technetium oxides provides a method whereby the gaseous radioactive oxides can be scrubbed from the gases of the processing zone and/or trapped in the event gaseous Ru, Mo or Tc oxides escape from the confines of the processing zone. The process involves contacting gaseous reprocessing streams with the oxides or carbonates or mixtures of both of alkaline earth materials or mixtures of said alkaline earth materials, or lanthanum oxide or lead oxide, at a temperature above about 400° C, preferably above 450° C, most preferably above 500° C, but less than 1000° C. A nonvolatile ruthenate, molybdate or technetates will be generated which can be handled with relative ease by disposal crews. It is desirable that the alkaline earth oxides and/or carbonates or lanthanum oxide or lead oxide which are used in the practice of the invention have a surface area as great as possible and generally range from 25 to 160 $m^2/g$. Supported alkaline earth carbonates have been prepared having surface areas of 150–160 $m^2/g$. Carbonates and oxides of from 25–50 $m^2/g$ have also been made. The material may be used in a powder unsupported form but is preferably utilized in a supported form, that is, deposited upon a ceramic, refractory base which is selected from the group consisting of alumina, silica, zeolites, cordierite and inorganic refractory oxides commonly used as catalyst supports. The support may be in pellet or extrudate form, preferably in the form of honeycomb extrudates since this will eliminate the problem of "fines" handling. By using honeycomb extrudates, good gas-solid contacting is insured and pressure drop is kept to a minimum. The honeycomb extrudate is coated with from 5 to 50% weight loading of the alkaline earth oxide and/or carbonate and/or mixtures thereof or lanthanum oxide or lead oxide of choice. Preferably, the loading ranges from 10–20%.

In a typical nonlimiting embodiment, the instant invention can be described as follows: An alkaline earth compound represented by $BaCO_3$ deposited on a ceramic honeycomb such as cordierite ($MG_2Al_4Si_5O_{18}$) is heated to about 600° C and a gas stream containing the volatile radioactive Ru oxide passes through it. The volatile ruthenium oxide reacts with the $BaCO_3$ to form the stable nonvolatile $BaRuO_3$ which can be disposed of.

In order to demonstrate the concept of alkaline earth trapping of volatilized ruthenium oxides, a series of experiments was devised. Initially, it was found that gaseous ruthenium oxide volatilized from hydrated ruthenium dioxide contained in a ceramic boat in a flowing oxygen stream at 750° C would cause the darkening of the surface of powdered calcium carbonate contained in another boat at the same temperature but located down-flow from the ruthenium source. This indicated the ability of $CaCO_3$ to pull volatilized ruthenium oxides out of the gas phase.

In order to determine the minimum temperature necessary for the reaction between the alkaline earth metal carbonates and Ru oxides to occur, bulk chemical reactions were performed employing thermogravimetric analysis (TGA). In these experiments, the three alkaline earth metal carbonates were individually mixed with hydrated ruthenium dioxide. Samples of each of the three mixtures were then heated in an oxygen atmosphere and the weight of the sample monitored as the temperature was raised. A large loss of weight indicative of the loss of carbon dioxide from the carbonate was taken as evidence for reaction to form the mixed metal oxides. The minimum temperatures at which the desired reactions were found to occur at reasonable rates are listed in Table I.

TABLE I

| Minimum Reaction Temperatures | |
|---|---|
| $MCO_3 + RuO_2$ | $MRuO_3 + CO_2$ |
| M | T(° C) |
| Ca | 495 |
| Sr | 515 |
| Ba | 425 |

The above data indicate that $BaCO_3$ will form the stable ruthenate more readily (at lower temperatures) than the other carbonates tested. The lower reaction temperature of $CaCO_3$ relative to $SrCO_3$ can possibly be related to the inherent instability of $CaCO_3$ which spontaneously begins to lose $CO_2$ in an oxygen atmosphere at about 600° C. Both $SrCO_3$ and $BaCO_3$ retain their integrity to much higher temperatures ($T_{dec} > 1000°$ C).

EXPERIMENTAL

Initial trapping experiments which were conducted under dry oxidizing conditions constituted passing $RuO_4$ volatilized from solid $RuO_2$-$xH_2O$ in a moving $O_2$ stream over a bed of $MCO_3$ wherein M is selected from calcium, strontium or barium. After a preselected period of time at a preselected temperature (both of which are described in greater detail below) the bed was cooled and the alkaline earth metal carbonate was sectioned, homogenized and analyzed for ruthenium by X-ray fluorescence. The results for $CaCO_3$, $SrCO_3$ and $BaCO_3$ are represented graphically by FIGS. I, II and III respectively. In consideration of the fact as previously noted that $CaCO_3$ loses $CO_2$ at temperatures over 600° C and that therefore, the trapping agent was actually CaO at 750° C an additional run was performed wherein the $CaCO_3$ bed temperature was maintained at 600° C insuring that the reactive material was actually $CaCO_3$. This run is seen in FIG. IV.

As can be seen from the ruthenium profile in FIG. II, $SrCO_3$ (at 750° C) did not effectively trap gaseous ruthenium oxides since measurable concentrations were found in all parts of the bed. From the slope of the ruthenium profile at the exit from the bed it can be inferred that substantial quantities of gaseous ruthenium oxides passed completely through the bed. To eliminate such passage of volatile Ru oxides completely through the trapping bed the bed length should be lengthened. Also a decrease in bed temperature to ca. 600° C should also eliminate this problem and increase trapping efficiency as was shown to be the case in a subsequently described $BaCO_3$ example.

Experiments utilizing CaO at 750° C (FIG. I) $BaCO_3$ at 750° C (FIG. III) and $CaCO_3$ at 600° C (FIG. IV) demonstrated more acceptable ruthenium concentration profiles. While CaO at 750° C (FIG. I) allowed measurable amounts of Ru to migrate through 92% of the bed, it should be noted that this rather high percentage of the bed represents a ruthenium migration of approximately 1.38 inches. This distance is comparable to the distances of ruthenium migration in $BaCO_3$ (750° C) and $CaCO_3$ (600° C) of 0.75 inches and 1.25 inches respectively, under the same experimental conditions. In these cases, the ruthenium analyses indicated a steeper concentration profile in the front section of the bed with no indication for "tailing off" as is evident in the CaO (750° C) experiment. This tailing is interpreted as an indication of a somewhat decreased trapping efficiency for CaO (750° C) when compared to the behavior of $BaCO_3$ (750° C) and $CaCO_3$ (600° C). It should be noted, however, that the employed analytical procedure failed to show the sensitivity in this $BaCO_3$ case as had been shown in the other carbonate samples.

Flow of oxygen in all of these experiments was maintained at approximately 1 SCF/hour through a one-inch diameter tube. The carbonates were initially sintered at 750° C overnight in air ($CO_2$ atmosphere for $CaCO_3$) and then pulverized and sieved. For these experiments the particles were between 16 and 20 mesh. 250–500 mg of ruthenium was employed in each experiment and the stoichiometric trapping capacity of the employed beds was many times that of the volatilized ruthenium in these and all subsequent experiments.

TABLE II

| Stoichiometric Capacities of Trapping Materials | |
|---|---|
| Material | g Ru/g Cpd. |
| CaO | 1.82 |
| $CaCO_3$ | 1.01 |
| $SrCO_3$ | 0.68 |
| $BaCO_3$ | 0.51 |

WET CONDITIONS

In order to more closely mimic the volatilization of ruthenium as envisioned occurring in a nuclear fuels reprocessing plant, ruthenium oxides were generated in and volatilized from a boiling solution of concentrated nitric acid. The presence of the dissolver solution adds more variables to the reaction conditions. For example, water vapor is now present as is various nitrogen oxides ($NO_x$) which have appreciable vapor pressure over boiling nitric acid.

The presence of $NO_x$ is an important consideration which must be taken into account. To elaborate, the combination of $NO_x$, water vapor and oxygen can combine to give a rather acid gas stream. This acidic gas could then neutralize the basic alkaline earth metal carbonates as noted in the following equations:

$$2HNO_3 + MCO_3 \rightarrow M(NO_3)_2 + H_2O + CO_2$$

$$2HNO_2 + MCO_3 \rightarrow M(NO_2)_2 + H_2O + CO_2$$

While the alkaline earth metal carbonates are stable materials to rather high temperatures, the corresponding alkaline earth metal nitrates are rather unstable solids melting at relatively low temperatures. Hence the integrity of the trapping bed would be jeopardized and serious handling complications could ensue if formation of these compounds occurred.

Two experiments employing $BaCO_3$ as the trapping media were performed under wet conditions. in the first, during which the trapping bed was maintained at about 750° C a soluble ruthenium complex $[Ru(NO)(NO_3)_3]$ was employed as the ruthenium source. This material is highly soluble in nitric acid. Potassium permanganate was added to the solution to create the necessary conditions for oxidation of the ruthenium to the high oxidation state volatile oxides $RuO_3$ and $RuO_4$. Oxygen was sparged through the solution as a carrier gas and to maintain oxidizing conditions in the vapor state. The ruthenium concentration profile for this experiment is shown in FIG. V. It is evident here that although no measurable ruthenium was found in the latter part of the bed, the ruthenium has migrated over a rather large portion of the bed. This could be indicative of a poor trapping efficiency for $BaCO_3$ under the employed conditions of temperature, gas flow and gas composition. A second experiment was carried out in which the furnace temperature was lowered to 600° C. In this experiment the source of ruthenium was hydrated ruthenium dioxide ($RuO_2 \cdot {}_xH_2O$). This material is insoluble in the acid solution employed but with the addition of potassium permanganate, volatile ruthenium oxides are produced with ease. In this case, under similar flow conditions, all of the trapped ruthenium was concentrated in the front 30% of the bed (FIG. VI). Even though this experiment proceeded for the same amount of time as the previous higher temperature run, no indication of ruthenium migration further into the bed was noted. Hence, it would appear that the lower temperature allows more efficient cleanup of the volatile ruthenium oxides from the gas stream.

What is claimed is:

1. A process for the prevention of the escape of volatile radioactive oxides selected from the group consisting of oxides of ruthenium, molybdenum and technetium outside the reprocessing zone during the reprocessing of nuclear fuel comprising contacting the volatile radioactive oxides with a trapping agent selected from the group consisting of the oxides of calcium, strontium, barium, the lanthanides, lead and mixtures thereof, and the carbonates of calcium, strontium, barium, the lanthanides and mixtures thereof and mixtures of the oxides and carbonates of calcium, strontium, barium, lead and the lanthanides at a temperature sufficient to yield a nonvolatile ruthenate, molybdate or technetate.

2. The process of claim 1 wherein the volatile radioactive oxide is a ruthenium oxide.

3. The process of claim 2 wherein the volatile radioactive ruthenium oxide is $RuO_4$.

4. The process of claim 1 wherein the trapping agent is selected from the group consisting of calcium oxide, strontium oxide, barium oxide, calcium carbonate, strontium carbonate, barium carbonate and mixtures thereof.

5. The process of claim 1 wherein the volatile radioactive oxide and the trapping agent are contacted at a temperature of over about 400° C.

6. The process of claim 5 wherein the temperature is over about 500° C.

7. The process of claim 5 wherein the temperature is over about 600° C.

8. The process of claim 1 wherein the trapping agent is selected from the group consisting of calcium carbonate, strontium carbonate, barium carbonate and mixtures thereof.

9. The process of claim 8 wherein the contacting temperature is over 600° C but less than 750° C.

10. The process of claim 1 further characterized in that the trapping agents are supported on an inert support selected from the group consisting of alumina, silica, zeolites, cordierite and mixtures thereof.

11. The process of claim 10 wherein the trapping agent is supported on cordierite at a loading of from 10 to 20 wt.%.

* * * * *